350-345 SR
PM012 XR 4,578,672

United States Patent [19]

Oota et al.

[11] Patent Number: 4,578,672

[45] Date of Patent: Mar. 25, 1986

[54] COLOR LIQUID CRYSTAL DISPLAY DEVICE

[75] Inventors: Makoto Oota; Masamichi Nekozuka, both of Kanagawa; Kikuji Yagishita, Tokyo, all of Japan

[73] Assignee: Mitsubishi Denki Kabushiki Kaisha, Tokyo, Japan

[21] Appl. No.: 499,768

[22] PCT Filed: Sep. 29, 1982

[86] PCT No.: PCT/JP82/00394

§ 371 Date: May 31, 1983

§ 102(e) Date: May 31, 1983

[87] PCT Pub. No.: WO83/01332

PCT Pub. Date: Apr. 14, 1983

[30] Foreign Application Priority Data

Sep. 30, 1981 [JP] Japan ..... 56-155967

[51] Int. Cl.[4] ..... G09G 3/36

[52] U.S. Cl. ..... 340/702; 340/784; 340/815.1; 358/44

[58] Field of Search ..... 340/701, 702, 703, 704, 340/784, 765, 815.06, 815.07, 815.1, 700; 358/59, 60, 61, 44

[56] References Cited

U.S. PATENT DOCUMENTS

| | | | |
|---|---|---|---|
| 3,982,274 | 9/1976 | Chai | 358/44 |
| 4,063,231 | 12/1977 | Mayer et al. | 340/703 |
| 4,384,279 | 5/1983 | Fujita et al. | 340/700 |
| 4,410,887 | 10/1983 | Stolov et al. | 340/701 |
| 4,481,530 | 11/1984 | Wagensommer et al. | 340/702 |

FOREIGN PATENT DOCUMENTS

| | | | |
|---|---|---|---|
| 53-122996 | 9/1979 | Japan | 340/702 |

*Primary Examiner*—Marshall M. Curtis
*Attorney, Agent, or Firm*—Sughrue, Mion, Zinn, Macpeak, and Seas

[57] ABSTRACT

A color liquid crystal display device of the invention has a number of liquid crystal panels (10) which are connected, in matrix form, to one another to provide a large screen, each panel having a plurality of groups of liquid crystal cells (102, 103 and 104) displaying three primary colors on a transparent substrate (4). Light transmitted from behind the panel is controlled by voltages applied to the liquid crystal cells (102, 103 and 104), so that the three primary colors are mixed to perform full-color large screen display.

10 Claims, 10 Drawing Figures

COLOR LIQUID CRYSTAL DISPLAY DEVICE

DESCRIPTION

1. Technical Field

This invention relates to a full-color large-screen display device using liquid crystal, which is suitable as a large television screen or a graphic panel for advertizement.

2. Background Art

No suitable high-resolution full-color large-screen (3 to 20 $m^2$) display device has been proposed in the art. If it is intended to realize a large screen in full colors with liquid crystal, then the liquid crystal must be driven in a static mode, and several hundreds of thousands of drive elements are required. Even if the elements are provided as integrated circuits, still several tens of thousands of integrated circuits are needed. This is one of the factors which obstructs provision of a large screen.

Another factor is that it is required to connect several hundreds of thousands of conductors to the output terminals of the liquid crystal.

DISCLOSURE OF THE INVENTION

In the invention, for instance the red, green and blue electrodes of a liquid crystal display unit are made different in area from one another, to simplify the control circuit, and a printed circuit board incorporating the control circuit is arranged substantially perpendicular to the display screen, which makes it possible to juxtapose a number of liquid crystal display units thereby to form a large screen.

BRIEF DESCRIPTION OF THE DRAWINGS

The parts (a) and (b) of FIG. 1 are a front view and a sectional side view showing a liquid crystal panel according to one embodiment of this invention.

BEST MODE FOR CARRYING OUT THE INVENTION

A liquid crystal display device according to this invention which is employed as a large screen display device will be described with reference to the accompanying drawings.

Figure 1A:
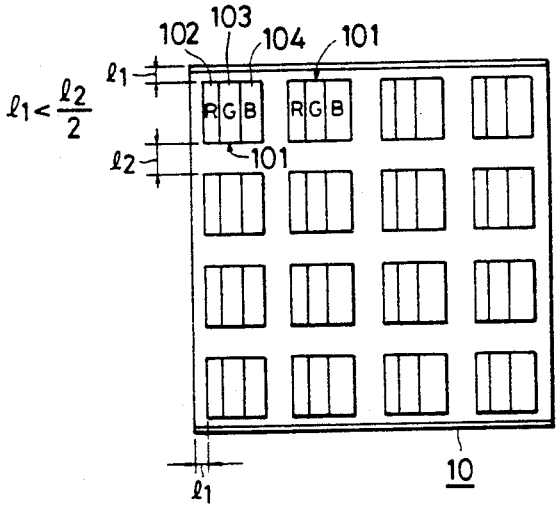
Figure 1B:
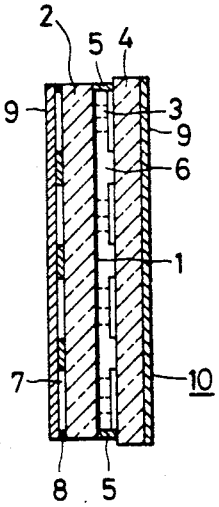

The part (a) of FIG. 1 is a front view of a liquid crystal panel 10, and the part (b) of FIG. 1 is a sectional side view of the same. A number of such liquid crystal panels 10 are assembled together to form a large screen display device as described later.

The construction of the liquid crystal panel 10 will be described. A glass substrate (A) 2 having a transparent common electrode 1 on its one surface is confronted with a glass substrate (B) 4 having a number of sets of transparent electrodes 3 (each set having three transparent electrodes 3 different in area (which are arranged horizontally in the case of the part (a) of FIG. 1)) on it one surface in such a manner that the surfaces of electrodes 3 confront the surface of electrode 2. A liquid crystal 6 is sealed in the space defined by the two glass substrates with sealing members 5. Red (R), green (G) and blue (B) color filters 7 correspohding to the electrodes 3 of the glass substrate (B) 4 and a light-shielding mask 8 are formed, for instance, by printing on the surface of the glass substrate (A) 2. Polarizing plates 9 are bonded to the outer surfaces of the glass substrates (A) and (B) 2 and 4 with the polarization axes coinciding with each other, to form the liquid crystal panel 10. Hereinafter, one section comprising three transparent electrodes 3 in a group and the corresponding R, G and B color filters 7 will be referred to as "a picture element", when applicable. That is, a number of picture elements 101 forms the liquid crystal panel 10, and a number of display modules (described later) incorporating the liquid crystal panels 10 form a large screen display device.

Figure 2:
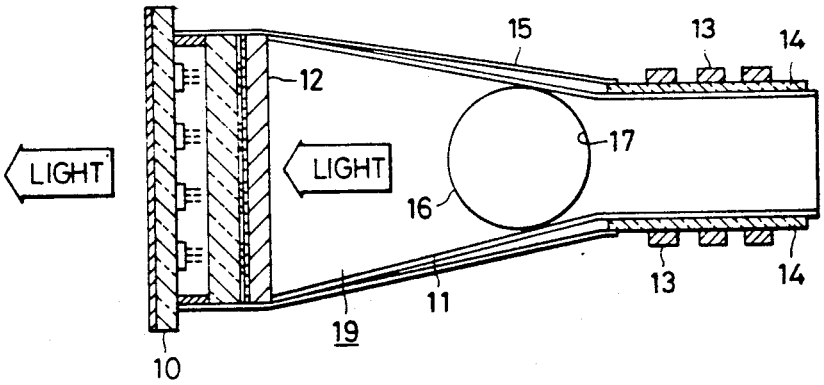
FIG. 2 is a sectional view of a display module.
Figure 3:
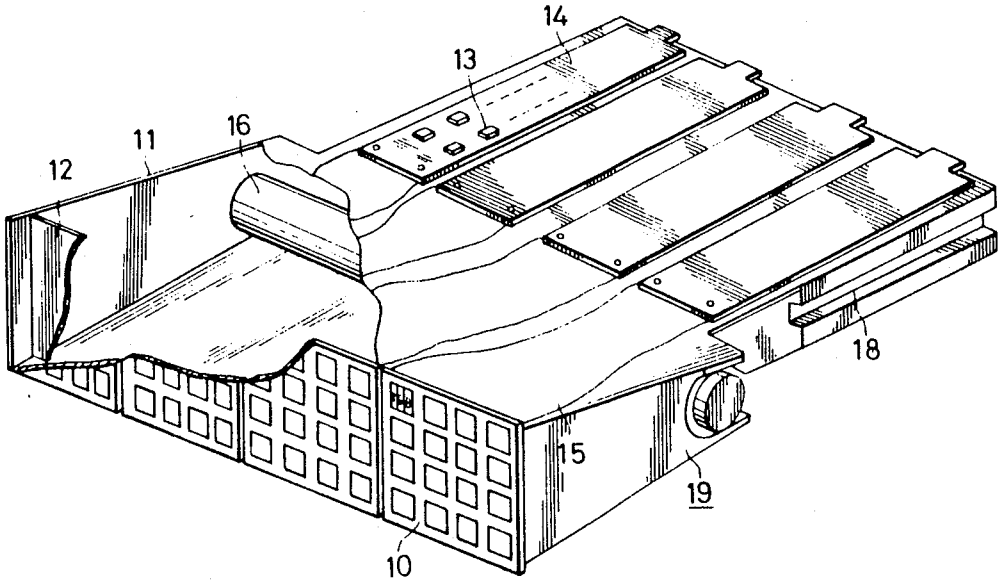
FIG. 3 is a perspective view showing the entire arrangement of the display module.

FIGS. 2 and 3 are a sectional side view and a perspective view of the display module 19 with the liquid crystal panel 10 respectively. In these figures, reference numeral 11 designates a housing the front surface of which is a diffusing plate 12 for scattering light. A plurality of liquid crystal panels 10 are bounded to the front surface of the diffusing plate 12 with transparent adhesive. Liquid crystal driving electronic parts 13 are mounted on a printed circuit board 14, which is mounted on the housing 11. The printed circuit board 14 is electrically connected to the liquid crystal panel 10 through a flexible printed circuit board 15. Reference numeral 16 designates a fluorescent lamp a part of the inner surface of which is cover with a reflecting film 17 which is formed by vacuum-evaporating titanium oxide or aluminum. The lamp 16 is detachably mounted inside the housing 11 in such a manner as to be in parallel with the liquid crystal panels 10. Reference numeral 18 designates guide grooves formed on both sides of the housing 11. A number of display modules 19 are combined together by using the guide grooves 18 as shown in FIG. 4, to form a large screen display device.

Figure 4:
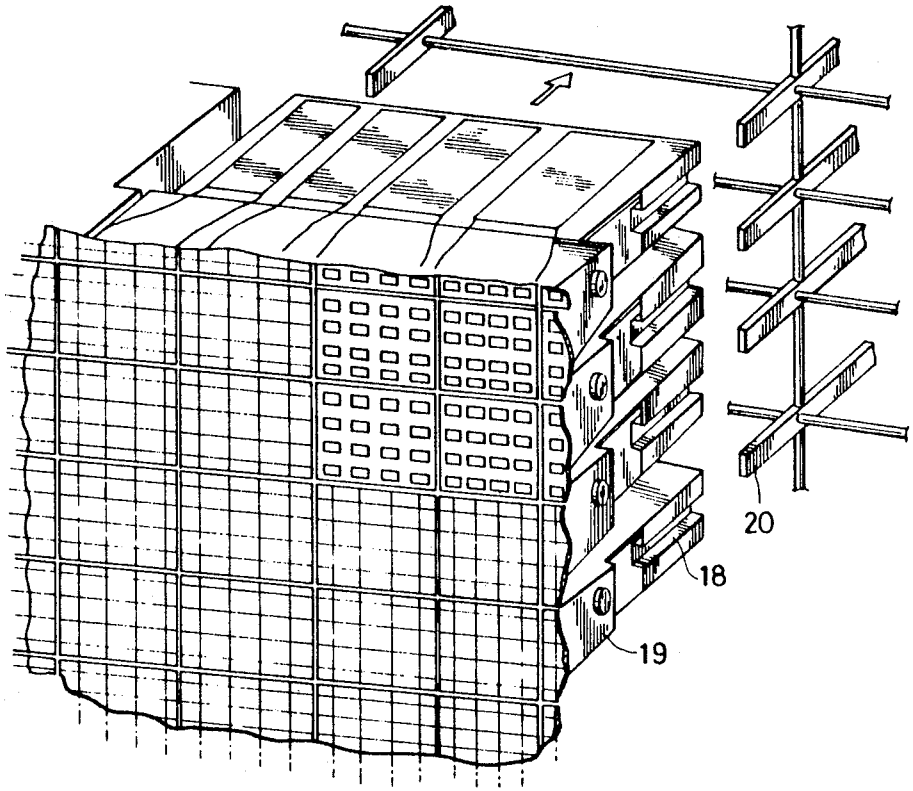
FIG. 4 is a perspective view showing a method of forming a large screen with a number of display modules.

In FIG. 4, reference numeral 20 designates a frame for detachably supporting a plurality of display modules 19.

Figure 5:
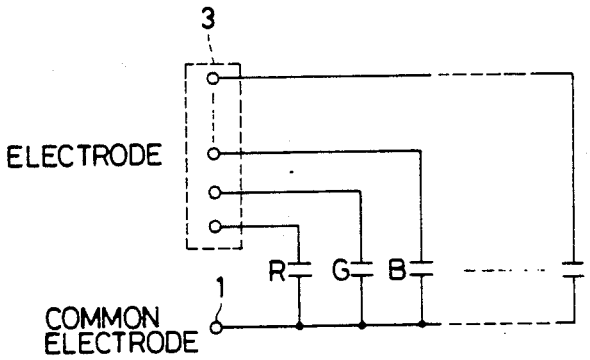
FIG. 5 is a diagram for a description of the electrical connection of the electrodes of the liquid crystal panel.
Figure 6:
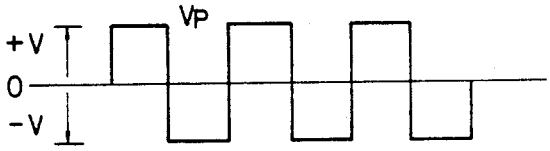
FIG. 6 is a diagram showing an example of the waveform of a voltage applied to an electrode in the liquid crystal panel. The parts (a) and (b) of FIG. 7 are a front view and a plan view of a liquid crystal panel which uses guest-host type liquid crystal cells.

FIG. 5 is a diagram showing the electrical connection of the liquid crystal panel 10. When control voltages are applied to the electrodes, the amounts of light passed through the R, G and B parts are changed, so that color mixing occurs to display a number of colors. FIG. 6 shows one example of the waveform of a voltage applied between the common electrode 1 and the electrodes of the liquid crystal panel 10.

The operation of the display device thus constructed will be described. First, the electrical and optical operations of the liquid crystal panel 10 in FIG. 1 will be described.

It is assumed that a twisted nematic liquid crystal is employed as the liquid crystal 6. As the polarizing plates 9 are placed on the outer surfaces of the glass substrates (A) and (B) 2 and 4 with the polarization axes coincident with each other, when no voltage is applied between the common electrode 1 and the electrodes 3 light is blocked, and when voltage is applied therebetween light is passed, and the light thus passed is emitted outside after being colored by the color filter 7. The electrodes of the liquid crystal panel are connected as indicated in FIG. 5, and voltages the waveforms of which are as shown in FIG. 6 are individually applied to the electrodes. That is, the optical transmissivity is a function of the voltage applied between the common electrode 1 and the electrode 3. Therefore, if one observes a picture element at a sufficiently long distance which is made up of the electrodes 1 and 3 corresponding to the R, G and B of the color filter 7, then he can see a mixed color owing to the principle of additive mixture of colors. Accordingly, colors can be obtained as desired by changing the combinations of voltages applied between the electrodes 1 and 3.

The principle of additive mixture of colors is well known in the field of color television. The distance ($l_1$) between an edge of the liquid crystal panel 10 and a picture element and the distance ($l_2$) between adjacent picture elements are so selected as to satisfy $l_1 < l_2/2$. Accordingly, when a plurality of liquid crystal panels 10 are connected together, the distance between picture elements is maintained unchanged.

This results in a smooth connection of pictures when a large screen is formed by connecting a number of liquid crystal panels.

FIG. 4 shows a method of realizing a large screen, or a large display board, with the display modules 19. Reference numeral 20 designates the frame as described before. The frame 20 has a number of arms which are equal in pitch to the guide grooves 18 of the housings 11. A large screen display board can be formed merely by inserting the arms into the guide grooves 18 of the modules 19.

In the above-described embodiment, three colors: red (R), green (G) and blue (B) are employed and the areas of the electrodes for the colors are made different from one another. The ratio of the areas is determined from the colors of color filters used.

Figure 7A:
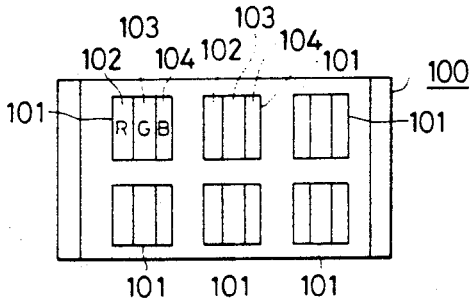
Figure 7B:
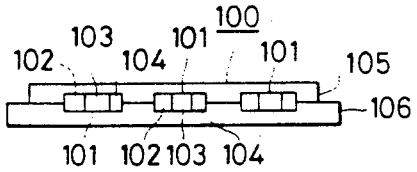

Another embodiment of the invention, which employs a guest-host type liquid crystal cell, will be described. The part (a) of FIG. 7 is a front view of a liquid crystal panel using the guest-host type liquid crystal cell, and the part (b) of FIG. 7 a plan view of the same. Reference numerals 102, 103 and 104 designate guest-host type liquid crystal cells containing nematic type liquid crystal.

Figure 8:
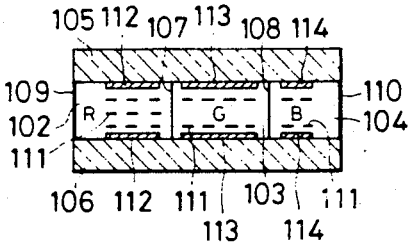
FIG. 8 is a sectional view showing the structure of the guest-host type liquid crystal cells.

The structure of the liquid crystal cells will be described with reference to FIG. 8 in detail.

The liquid crystal cells 102, 103 and 104 are juxtaposed between two glass plates 105 and 106, and are separated from one another by partition frames 107 and 108. Reference numerals 109 and 110 designate liquid crystal sealing frame plates.

These liquid crystal cells 102, 103 and 104 are guest-host type liquid crystal cells injected with nematic type liquid crystal. The cells 102, 103 and 104 are so separated from one another by the partition frames 107 and 108 that the display area of the cell 102 is smaller than that of the cell 103 and the display area of the cell 104 is smaller than that of the cell 102. The liquid crystal 111 of the liquid crystal cell 102 contains red displaying dye molecules, the liquid crystal 111 of the liquid crystal cell 103 contains green displaying dye molecules, and the liquid crystal 111 of the liquid crystal cell 104 contains blue displaying dye molecules. The liquid crystal cells 102, 103 and 104 have a pair of transparent electrodes 112, a pair of transparent electrodes 113 and a pair of transparent electrodes 114, respectively, inside the glass plates 105 and 106. The display areas of the electrodes 112, 113 and 114 are decreased in the stated order. These electrodes are electrically connected to external terminals.

The operation of the above-described liquid crystal display unit 100 will be described. When, under the condition that no voltage is applied to the liquid crystal cells of the liquid crystal display unit 100, light is applied thereto through a neutral polarization plate or the like, then the liquid crystal cells 102, 103 and 104 provide red, green and blue light beams, respectively Since, in this case, the crystal liquid cells are different in display area from one another as described above, the colored light beams from the liquid crystal cells which are different in the quantity of light are mixed to form a delicately colored light beam.

Let us consider the case where only one of the three liquid crystal cells is applied with voltage. For instance in the case where voltage is applied to the liquid crystal cell 102 only, the orientation of the liquid crystal in the cell 102 is changed, so that light incident thereto is passed therethrough as it is and accordingly no red light beam is provided by the cell 102. Accordingly, the green light beam from the liquid crystal cell 103 and the blue light beam from the liquid crystal cell 104 are mixed to provide a colored light beam. The color light beam is a delicately colored light beam because the cells 103 and 104 are different in coloring area.

In the above-described embodiment, the liquid crystal in each cell is orientated homogeneously; however, the same effect can be obtained even if it is orientated homeotropically. In the latter case, the above-described relation between resultant colored light beams and application of voltage should be reversed.

As is apparent from the above description, according to the invention, the module structure is employed which comprises the liquid crystal panels and the fluorescent lamp and has the printed circuit boards and the diffusion plates integrally, and the electrodes of each liquid crystal panel are independent. Thus, a full-color large-screen display board having a desired size can be realized according to the invention.

A large screen display board using the display modules can be suitably employed as a huge television screen or a large graphic panel.

In the above-described embodiment, three different liquid crystal cells are employed to display primaries. However, for a special purpose of use, two different liquid crystal cells may be employed.

We claim:

1. A large screen color liquid crystal display device, which comprises a number of modules which are connected to one another to form said large screen liquid crystal display device, each said module comprising:

a housing;

a plurality of adjacent liquid crystal panels which are arranged on the front surface of said housing, each liquid crystal panel comprising a plurality of liquid crystal picture elements, each said picture element including at least two electrodes which are different in electrode area from each other and are electrically independent, a plurality of color filters arranged in correspondence to said electrodes, a common electrode confronting said independent electrodes, and liquid crystal interposed between said common electrode and said independent electrodes, and polarizing plates, printed circuit boards including drive circuits for driving said liquid crystal panels, respectively, said printed circuit boards being arranged longitudinally of said housing, and a fluorescent lamp arranged inside said housing and in parallel with said adjacent liquid crystal panels.

2. A device as claimed in claim 1, in which said modules are coupled to one another through guide grooves which are formed on both sides of each housing.

3. A device as claimed in claim 1, CHARACTERIZED in that a diffusing plate is provided between said fluorescent lamp and said liquid crystal panels.

4. A device as claimed in claim 1, CHARACTERIZED in that $\mathbf{1}_1 < \mathbf{1}_2/\mathbf{2}$ where $\mathbf{1}_1$ is the distance between an edge of each liquid crystal panel and a picture element, and $\mathbf{1}_2$ is the distance between adjacent picture elements.

5. A large screen color liquid crystal display device comprising a number of modules which are connected to one another to form said large screen liquid crystal display device, characterized by each of said modules comprising:

a housing;

a plurality of liquid crystal panels arranged on the front surface of said housing, each said liquid crystal panels comprising a plurality of liquid crystal picture elements, each said picture element including at least two electrodes, which are different in electrode area from each other and are electrically independent; and printed circuit boards for independently controlling and driving said liquid crystal panels, respectively, said printed circuit boards being arranged longitudinally of said housing so as to be substantially perpendicular to the front surface of said module.

6. The large screen color liquid crystal display device as claimed in claim 5, wherein each said housing is provided with guide grooves at both sides thereof so that a number of said modules are combined together through said guide grooves to form said large screen liquid crystal display device.

7. The large screen color liquid crystal display device as claimed in claim 5, wherein said liquid crystal panel is a twisted nematic liquid crystal cell.

8. The large screen color liquid crystal display device as claimed in claim 5, wherein said liquid crystal panel is a guest-host type liquid crystal cell.

9. The large screen color liquid crystal display device as claimed in claim 5, wherein each of said modules comprises a fluorescent lamp arranged in parallel with said liquid crystal panel.

10. The large screen color liquid crystal display device as claimed in claim 5, wherein $\mathbf{1}_1 < \mathbf{1}_2/\mathbf{2}$ where $\mathbf{1}_1$ is the distance between an edge of each liquid crystal panel and a picture element and $\mathbf{1}_2$ is the distance between adjacent picture elements.

* * * * *